US005137439A

United States Patent [19]

Lundin

[11] Patent Number: 5,137,439

[45] Date of Patent: Aug. 11, 1992

[54] SCREW ROTOR MACHINE WITH DE LAVAL NOZZLE FOR NOISE REDUCTION

[75] Inventor: Stig Lundin, Värmdö , Sweden

[73] Assignee: Svenska Rotor Maskiner AB, Stockholm, Sweden

[21] Appl. No.: 721,492

[22] PCT Filed: Feb. 16, 1990

[86] PCT No.: PCT/SE90/00016

§ 371 Date: Jul. 9, 1991

§ 102(e) Date: Jul. 9, 1991

[87] PCT Pub. No.: WO90/09523

PCT Pub. Date: Aug. 23, 1990

[30] Foreign Application Priority Data

Feb. 17, 1989 [SE] Sweden ..... 8900570

[51] Int. Cl.[5] ..... F04C 29/06

[52] U.S. Cl. ..... 418/181; 418/201.1; 417/312; 60/271; 181/226; 181/229; 181/403

[58] Field of Search ..... 418/181, 201.1; 417/312, 198, 187, 188; 60/271; 181/214, 215, 216, 226, 229, 403

[56] References Cited

U.S. PATENT DOCUMENTS

| | | | |
|---|---|---|---|
| 2,931,169 | 4/1960 | Glenn | 181/215 |
| 3,534,831 | 10/1970 | Nagamatsu | 181/215 |
| 3,720,482 | 3/1973 | Tell | 417/187 |
| 3,884,664 | 5/1975 | Edwards | 181/226 |
| 3,999,898 | 12/1976 | Chomczyk et al. | 417/443 |
| 4,727,651 | 3/1988 | Nakajima | 181/214 |

FOREIGN PATENT DOCUMENTS

| | | | |
|---|---|---|---|
| 611659 | 4/1935 | Fed. Rep. of Germany . | |
| 3545212 | 12/1987 | Fed. Rep. of Germany . | |
| 652625 | 3/1929 | France . | |
| 630440 | 9/1978 | U.S.S.R. | 418/201.1 |
| 1049137 | 4/1965 | United Kingdom . | |

*Primary Examiner*—Richard A. Bertsch
*Assistant Examiner*—David L. Cavanaugh
*Attorney, Agent, or Firm*—Frishauf, Holtz, Goodman & Woodward

[57] ABSTRACT

A screw rotor machine which incorporates a sound silencing device in the vicinity of the inlet and/or outlet port. The sound silencing device comprises a De Laval nozzle (8) having a valve body (9) which is movable axially in relation to the nozzle. When the machine is shut-down, the valve body (9) lies sealingly against the opening (8A) of the nozzle. When increasing the capacity of the machine to full load, the valve body (9) moves in the opening direction under the influence of a damping force and against the action of a substantially constant spring force (14), so as to maintain a flow rate immediately beneath the sound of speed in the smallest area (8A) of the nozzle (8).

5 Claims, 1 Drawing Sheet

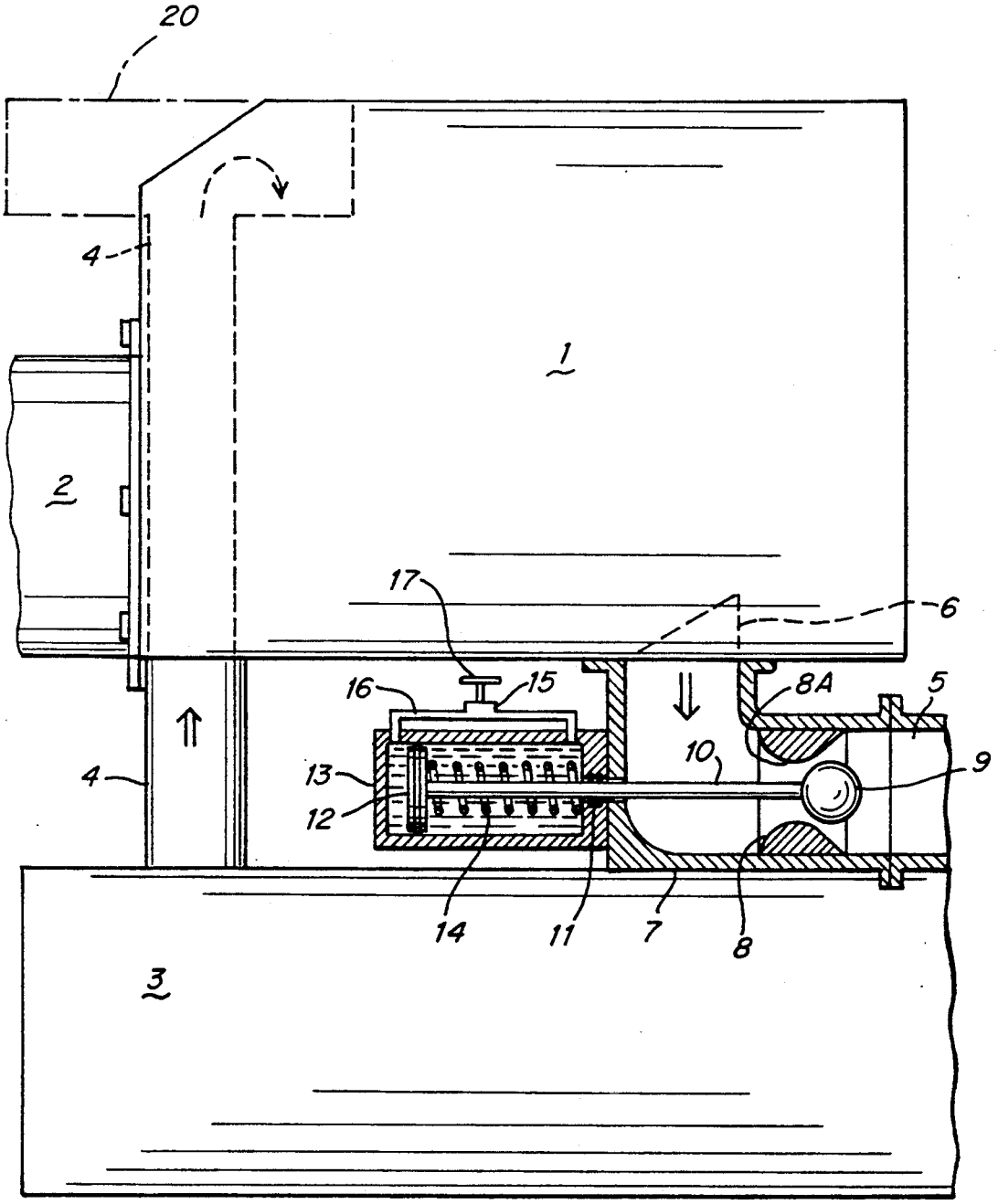
20
4
1
2
17
6
16
15
8A
5
10
9
4
13
12
14
11
7
8
3

SCREW ROTOR MACHINE WITH DE LAVAL NOZZLE FOR NOISE REDUCTION

SUMMARY OF THE INVENTION

The present invention relates to a screw rotor machine which has a sound silencing device mounted on the inlet and/or the outlet side thereof.

The problem of damping sound in screw rotor machines is difficult to master, at least when the space available therefor is restricted, as is normally the case.

This is mainly because both the inlet line and the outlet line, and particularly the latter, conduct low-frequency noise of large amplitudes in the machine, which must be dampened.

A suitable silencer for this purpose is the so-called De Laval nozzle. One distinguishing feature of this known nozzle is that a switch to critical flow-sound velocity occurs in the smallest throughflow area when a given pressure ratio is exceeded. The De Laval nozzle is therefore a non-linear resistance through which wide fluctuations in pressure on the inside of the silencer are unable to penetrate. This effect is particuarly valuable in the case of low-frequency pressure fluctuations, which normally require silencers of large volume. In order to utilize the De Laval nozzle effectively, throttling is adapted so that the mean flow rate will lie immediately beneath the sound velocity.

DETAILED DESCRIPTION

Adaptation of the throttling effect, however, is quite critical. When varying the size of the static gas flow, it is necessary to adapt the smallest area to the maximum gas flow, since otherwise the losses will be too high. This also means that a poor silencing effect, or no silencing effect at all, will be attained at part loads.

The object of the present invention is to provide a screw rotor machine provided with at least one silencer which is effective over substantially the whole capacity range of the machine.

This object is achieved in accordance with the invention with a machine having the characteristic features set forth in the following claim 1. The movable valve body, which is biased by a substantially constant spring force, functions to maintain a substantially constant pressure drop across the Laval-nozzle, thereby enabling the gas velocity to lie immediately beneath the speed of sound, this feature being a characteristic of the Laval-nozzle, irrespective of machine capacity. Movement of the valve body must also be dampened, so that solely slow changes in gas flow will be influential, such as when changing the capacity of the machine.

BRIEF DESCRIPTION OF THE DRAWING

The invention will now be described in more detail with reference to the accompanying drawing, the single FIGURE of which is a schematic side view, in longitudinal section of an exemplifying embodiment of an inventive screw rotor machine provided with a sound damping device.

DETAILED DESCRIPTION

The machine illustrated in the drawing is a screw-rotor compressor 1, which forms part of a refrigerating system, and a drive motor 2, both of which machine members are mounted on top of an evaporator 3. An inlet line 4 passes from the evaporator to the low pressure side of the compressor 1, and an outlet line 5 passes from the compressor to a refrigerating circuit (not shown).

The outlet line 5 is connected to a pipe-bend which extends from the outlet port 6 of the compressor and in which a De Laval nozzle 8 is arranged. A spherical valve-body 9 is journalled downstream of the De Laval nozzle 8 for axial movement in relation to said nozzle, said movement being effected with the aid of a piston rod 10 which is slideably mounted in a sealing lead-through 11 mounted in the wall of the pipe-bend 7.

Attached to the piston rod 10 is a piston 12 which is slideably mounted in a cylindrical housing 13. The housing 13 has mounted therein a spring 14 which endeavours to hold the valve body 9 in sealing abutment with the through-flow opening 8A of the nozzle 8. The interior of the housing 13 contains a liquid, suitably oil, and communicates with a throttle valve 15 through the intermediary of two pipes 16 which discharge in the close proximity of the end walls of the housing 13. The valve 15 is provided with means 17 for adjusting the area of the constriction or throttle.

The spring 14 has a substantially constant spring force, which is adapted so that the valve body 9 will be opened sufficiently for the gas flow, mixed with oil and refrigerant droplets, leaving the compressor to be accelerated to a level close to the acoustic velocity when passing between the nozzle 7 and the valve body 9.

When a change occurs in the value of the gas flow, the position of the valve body 9 relative to the nozzle 8 will change while the spring 14 maintains a constant pressure drop over the nozzle 8. Rapid pulsations which are superimposed on the gas flow will not, on the other hand, affect the valve body 9, since the throttle valve 15 will only permit slower movements of the piston 12, and therewith the piston rod 10 and the valve body 9.

Large pressure fluctuations on the inside of the nozzle promote rapid rises in pressure over the nozzle and therewith an instantaneous switch-over to critical flow in the gap between the nozzle and the valve body, therewith preventing these noise-representing pressure fluctuations or impact waves from passing through the nozzle.

This results in effective sound damping at mutually different flow velocities of the gas from the compressor with the aid of an arrangement of very small dimensions. This is particularly pronounced at low-frequency impact waves, which normally require a silencer of large volume, which is difficult to provide in a high-pressure line as in the case of the outlet side of a compressor.

It will be understood that the invention is not restricted to the illustrated exemplifying embodiment and that modifications can be made within the scope of the inventive concept as defined in the following claims.

For instance, the valve body 9 may be extended in the flow direction and may optionally be manufactured from a material of such heavy weight as to achieve requisite damping of valve-body movements without the illustrated arrangement of the pipe 16 and valve 15 in the housing 13. Alternatively, a throttle valve can be provided in an opening in the piston 12, therewith rendering the pipe 16 and the valve 15 superfluous.

The piston-rod mounting may also be located fully within the pipe-bend 7 or in a corresponding straight pipe-connection.

As illustrated in chain lines 20, a silencer of this kind may also be provided at the compressor inlet.

The outlet side of the compressor may, at times, be integral with an oil separator, in which case the silencer will be mounted in the oil separator and form part of a very compact and effective sound silencing unit.

I claim:

1. In a screw rotor machine having a sound silencing device arranged on at least one of the inlet and outlet side (4, 5) thereof, the improvement wherein:

a De Laval nozzle (8) is mounted in close proximity to at least one of the inlet and outlet port of the screw rotor machine and is arranged to coact with a valve body (9) located downstream of the nozzle and movable in an axial direction against a substantially constant spring force, so as to produce a continuous increase in the smallest throughflow area (8A) controlled by the influence of the damping force (15), from zero to a maximum value when increasing the capacity of the screw rotor machine from a shut-down capacity to a full capacity, so as to maintain a throughflow rate which lies immediately beneath the sound of speed in at least said smallest throughflow area (8A).

2. A machine according to claim 1, wherein the valve body (9) is connected to a piston (12) which is movable in a liquid-filled cylinder contained by a housing (13), said piston functioning to drive a liquid flow in a conduit (16) containing a throttle (15).

3. A machine according to claim 2, wherein the housing (13) is mounted externally of at least one of an inlet and outlet conduit (5, 7) of the machine in the vicinity of a pipe-bend (7) of said conduit with a piston rod (10) which connects the piston (12) and the valve body (9) and which extends through the wall of the pipe-bend (7).

4. A machine according to claim 3, wherein the conduit (16) which includes the throttle (15) is arranged in a wall of the housing (13); and the throttle (15) is provided with means for adjusting the throttle and having setting means (17) provided on the outside of the housing.

5. A machine according to claim 3, wherein the conduit (16) which includes the throttle (15) is arranged externally on a wall of the housing (13); and the throttle (15) is provided with means for adjusting the throttle and having setting means (17) provided on the outside of the housing.

* * * * *